US005129453A

United States Patent [19]

Greenlee

[11] Patent Number: 5,129,453

[45] Date of Patent: Jul. 14, 1992

[54] QUICK SET WELL PACKER

[75] Inventor: Donald R. Greenlee, Cedar Hill, Tex.

[73] Assignee: Dresser Industries, Inc., Dallas, Tex.

[21] Appl. No.: 590,344

[22] Filed: Sep. 28, 1990

[51] Int. Cl.[5] ..... E21B 23/02

[52] U.S. Cl. ..... 166/119; 166/125; 166/143

[58] Field of Search ..... 166/387, 143, 123, 118, 166/119, 125

[56] References Cited

U.S. PATENT DOCUMENTS

| | | | |
|---|---|---|---|
| 4,375,240 | 3/1983 | Baugh et al. | 166/387 |
| 4,437,516 | 3/1984 | Cockrell | 166/134 X |
| 4,750,564 | 6/1988 | Pettigrew et al. | 166/134 X |
| 4,856,583 | 8/1989 | Greenlee et al. | 166/131 X |
| 4,862,961 | 9/1989 | Neff | 166/127 |

OTHER PUBLICATIONS

Baker Packers 1982-83 Catalog, p. 852.
Minimum Exposure Packer, Part No. 118-S-0109.

*Primary Examiner*—Ramon S. Britts
*Assistant Examiner*—Roger J. Schoeppel
*Attorney, Agent, or Firm*—Jones, Day, Reavis & Pogue

[57] ABSTRACT

An improved well packer for removeable installation in a well casing. A mandrel is associated with the packer for latching engagement with the well packer which can be released from the well packer by a simple rotation of the mandrel by no more than one-quarter turn. Arcuate 60° segments of teeth are formed on opposing sides of the mandrel and contact ratchetable arcuate 60° segments of teeth on opposing sides of the packer such that when the mandrel is moved longitudinally in relation to the packer, the ratchetable teeth can engage the fixed teeth on the mandrel. When it is desired to release the mandrel from the packer assembly, the mandrel is rotated no more than one-quarter turn and the mandrel teeth move out of engagement with the 60° segment of the ratchetable teeth, thus disengaging the mandrel from the packer.

18 Claims, 4 Drawing Sheets

QUICK SET WELL PACKER

FIELD OF THE INVENTION

The present invention relates to well packers in general and in particular to an improved well packer having a latching assembly that couples a cylindrical mandrel at the bottom of a drill string to the well packer through the use of arcuate segments of teeth on both the mandrel and the well packer which the ratchetably engagable with each other to lock the mandrel to the packer and which can be released from each other by a simple one-quarter rotation of the drill string to move the teeth on the mandrel out of locking engagement with the ratchetable teeth on the packer.

BACKGROUND OF THE INVENTION

It is well known in the petroleum industry that after a bore hole has been completed, there are occasions when corrosive fluids in the bore hole must be kept out of contact with the well pipe casing because of the rapid destruction of the well pipe casing and the inability to replace the casing either practically or economically. In order to protect that portion of the well casing that is immersed in such fluids, well packers have been developed which are lowered down the well casing to a given point and then set in the casing so as to cause a fluid seal in the casing, sealing off that portion of the corrosive fluid below the packer from the well casing above the packer. Since the drill string extends through the packer to the portion of the well fluid below the packer, fluids can be pumped through the well string to the surface through the drill string, thus protecting the well casing from the corrosive fluids.

Well packers are associated with a cylindrical mandrel attached to the lower end of the drill string. The mandrel is inserted through the hollow well packer and has formed on each side thereof a J-shaped slot which engages a gudgeon pin in the surrounding anchor cage that forms a part of the well packer. The anchor cage also has spring loaded friction pads spaced around the outside thereof, generally 90° apart, which engage the inside of the well casing and temporarily hold the well packer in a fixed position with respect to the well casing. The friction pads can support 200–300 pounds of weight without sliding. A gudgeon pin attached to and extending through opposite sides of the anchor cage engages a corresponding one of the J-slots. When the gudgeon pin is in the bottom portion of the J-slot, it is trapped and, by forcing the drill string downward, the packer is forced down into the well casing sliding the friction pads along the inside surface thereof.

When the proper depth at which the packer is to be set is reached in the bore hole, the friction pads hold the packer while the drill string is lifted slightly which releases each gudgeon pin from its trapped position at the bottom of the J-slots. By rotating the drill string slightly, the gudgeon pin is moved into the vertical section of the J-slot. The drill string can then be let down and the gudgeon pin travels upwardly in the J-slot. Forming a part of the mandrel, on the external surface thereof, is a band of threads or teeth. In like manner, on the anchor cage which contains the gudgeon pins are several arcuate segments of gear teeth that are urged inwardly against the mandrel by a resilient device such as a spring or springs. As the mandrel moves downwardly through the packer, the ratchetable teeth on the anchor cage slide over the band of teeth on the mandrel. The teeth are ratchetable in only one direction. As the mandrel moves downwardly with respect to the packer (which is being held in place by the friction pads) the teeth can ratchet with respect to each other. When the teeth are securely caught in locked engagement, the drill string is then pulled upwardly. A series of pivotable locking teeth in the anchor cage are forced outward against the well casing by a cam. These teeth are angled so as to prevent the anchor cage from moving downwardly in the well casing but not upwardly. As the mandrel continues to move the anchor cage upwardly, elastomer seals on the packer are compressed and a second cam on the upper side of the seals forces another set of locking teeth outwardly into the well casing to prevent upward movement of the slip in which the upper teeth are mounted. Continued upward movement of the drill string compresses the entire unit because the upper slip is now anchored by the locking teeth therein and will not move further upwardly. The lower teeth are engaged with the casing and will not allow the packer to move downwardly. The elastomer seals are compressed outwardly to engage the well casing and a fluid-tight seal is formed which prevents fluid below the packer from entering the well casing above the packer. Fluid in the well casing below the packer can be taken to the surface through the mandrel and the drill string.

When it is desired to remove the packer, the drill string has to be rotated in order to thread the latching teeth on the anchor cage off of the fixed teeth on the mandrel. Thus, it requires a considerable number of revolutions of the drill string to thread the anchor cage ratchetable teeth off the fixed mandrel teeth and, if the drill string should for any reason slip downwardly during the rotation, the ratchetable teeth simply slip over or ratchet across the fixed teeth on the mandrel and the process has to be started again.

The present invention overcomes the disadvantages of the prior art by limiting the teeth on the mandrel to an arcuate width of approximately 60° on opposing sides of the mandrel circumference. In like manner, the ratchetable teeth on the anchor cage also have an arcuate width of approximately 60°. The two sets of teeth operate in the normal fashion to latch so that the ratchetable teeth slide over the teeth on the mandrel when the mandrel is being lowered. Again, when the mandrel is pulled upwardly the teeth lock together holding the mandrel securely to the packer and allowing the packer to be set in place in the well casing as described earlier. When it is necessary to remove the packer however, the drill stem is simply rotated no more than one-quarter of a turn which moves the 60° segment of teeth on the mandrel out of contact with the 60° segment of ratchetable teeth on the anchor cage thus releasing the mandrel from the packer and allowing the mandrel to be pulled upwardly to disengage the packer from the sidewalls of the casing in the usual fashion.

The mandrel not only has the 60° segment of teeth on opposing sides thereof, but also has a J-slot below, and spaced from, the mandrel teeth to receive the gudgeon pin on the anchor cage. The J-slot is formed on diametrically opposing sides of the mandrel surface. The bottom end of the J-slots traps the anchor cage gudgeon pins, as in the prior art, so that the entire packer assembly can be forced down into the well casing against the resistance of the friction pads by downward movement of the mandrel on the end of the drill string. The vertical section of each J-slot has an upper portion and a lower portion with the upper portion being wider than lower portion. The upper portion is coupled to the lower portion by a first sloping shoulder on one side of the J-slot. The bottom end of the J-slot is coupled to the lower portion of the J-slot by a second sloping shoulder substantially parallel to the first sloping shoulder. The ratchetable arcuate segments of teeth on the anchor cage are mounted on opposed sides of the anchor cage above and arcuately spaced from the gudgeon pins such that when the gudgeon pins are in the bottom end of the J-slot, the anchor cage arcuate segments of teeth are received by the vertical J-slot in the area adjacent the first sloping shoulder. When the mandrel is rotated to move the gudgeon pins from the bottom end of the J-slot to and in alignment with the lower vertical portion of the J-slot, the gudgeon pins move up the second sloping shoulder thereby rotatably moving the anchor cage which carries the ratchetable segments of teeth and causes them to move upwardly and rotatably parallel to the first sloping shoulder to a position in vertical alignment with the mandrel 60° segments of teeth such that when the mandrel is subsequently lowered, the anchor cage arcuate segments of teeth ratchetably engage corresponding ones of the mandrel arcuate segments of teeth to secure the mandrel to the packer housing through the anchor cage.

The gudgeon pin moves up into the widest upper portion of the J-slot as the mandrel is lowered and the segments of teeth on the anchor cage engage the teeth segments on the mandrel. The gudgeon pin is then in a position such that when the mandrel is rotated one-quarter turn to disengage the arcuate segments of teeth, the gudgeon pin is enabled to move from one side of the widest portion of the J-slot to the other side. When the mandrel is raised, after the segments of teeth have been disengaged, the first sloping shoulder in the J-slot engages the associated gudgeon pin to rotate the anchor cage and bring the ratchetable arcuate segments of teeth thereon under and in vertical alignment with the corresponding arcuate segments of teeth on the mandrel. As the mandrel continues to be raised, the second sloping shoulder engages the gudgeon pin to further rotate the anchor cage and force the gudgeon pins into the bottom portion of the J-slot to carry the packer assembly as the mandrel is raised by the drill string. The anchor cage segments of ratchetable teeth are now in their original position in the J-slot adjacent the first sloping shoulder. The packer can now be removed from the well or reset as desired.

Thus, it is a primary object of the present invention to provide an improved well packer assembly which enables the mandrel to be disconnected or disengaged from the packing assembly simply by rotating the drill string one-quarter of a turn.

It is also an important object of the present invention to provide an improved latching assembly for releasably attaching a hollow well packer to an elongated tubular mandrel to enable the packer to be releasably set in fixed engagement with the well casing and released therefrom simply by rotating the drill string no more than one-quarter of a turn.

It is still another important object of the present invention to provide a latching assembly for a well packer and mandrel that has at least one arcuate section of fixed teeth integrally formed on the mandrel and at least one arcuate segment of ratchetable teeth mounted on the well packer such that when the mandrel is moved longitudinally in one direction with respect to the packer the segment of teeth on the anchor cage slides or ratchets over the fixed section of teeth on the mandrel to enable the packer to be set in the well casing, but fixedly engages the fixed section of teeth when the mandrel is moving longitudinally in the opposite direction with respect to the packer to rigidly attach the packer to the mandrel. However, the mandrel is allowed to be disengaged from the packer simply by rotating the drill string and mandrel one-quarter turn to release the ratchetable segment of teeth from the fixed section.

It is still another object of the present invention to provide a novel J-slot on diametrically opposed sides of the mandrel to receive a gudgeon pin on the anchor cage to move the anchor cage rotatably to align the ratchetable teeth on the anchor cage with the fixed sections of teeth on the mandrel and to receive the gudgeon pin when the drill string has been rotated a one-quarter turn to disengage the mandrel from the anchor cage and allow the gudgeon pin to be guided back into the J-slot so as to properly position the anchor cage for connection to the mandrel to enable removal of the well packer from the well casing.

BRIEF DESCRIPTION OF THE DRAWINGS

These and other objects of the present invention will be disclosed more fully in conjunction with the detailed description of the accompanying drawing in which like numerals, represent like elements and in which.

DETAILED DESCRIPTION OF THE DRAWINGS

Figure 1:
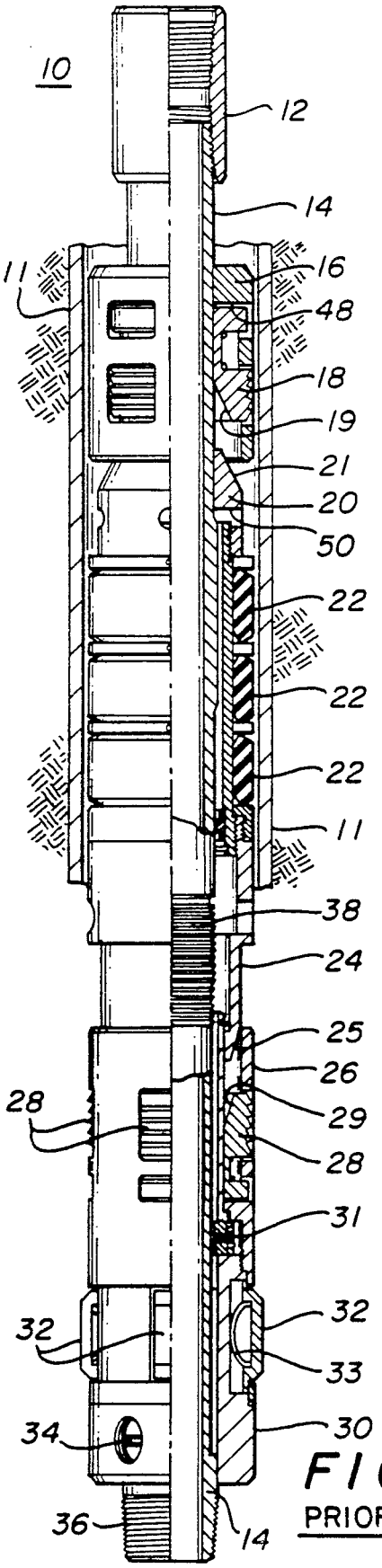
FIG. 1 PRIOR ART
FIG. 1 is a partial cross-sectional view of a prior art well packer illustrating the relationship of the mandrel to the packer and which has the 360° threads on the mandrel for engaging the ratchetable teeth on the anchor cage.

FIG. 1 is a partial cross-sectional view of a prior art well packer assembly generally designated by the numeral 10. A drill string coupler 12 is threadedly coupled to the upper end of a mandrel 14. The mandrel is hollow so that fluids in the well can travel through the mandrel and the drill string to the surface. The well packer has three basic elements: the upper slip 16, the elastomer seals 22 and the lower slip 26. Threadedly inserted in the lower portion of the lower slip 26 is an anchor cage 30. The upper slip 16 has a pivotal teeth carrier 18 therein that has a sloping conical surface 19. The lower slip 26 also has a pivotal teeth carrier 28 formed therein which also has a conical inner surface 29. The teeth on the upper slip 16 are angled such that when they are pivoted outwardly to contact the well casing 11 they prevent the packer 10 from moving upwardly in the well. The teeth 28 of lower slip 26 are angled such that when pivoted outwardly they contact the well casing 11 at an angle to prevent the packer 10 from moving downwardly in the well.

Figure 2:
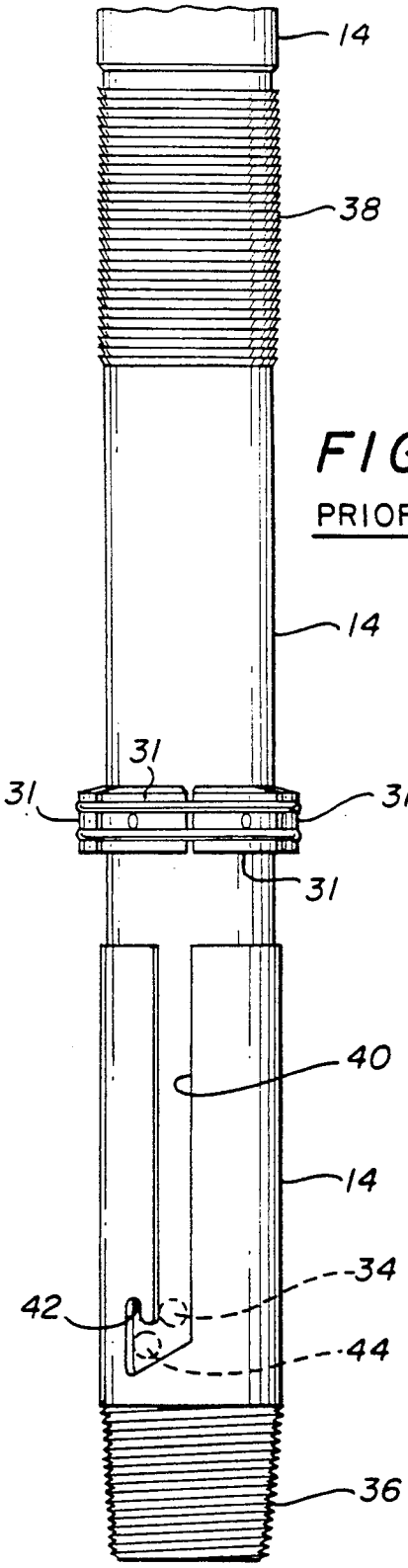
FIG. 2 PRIOR ART
FIG. 2 is a partial front view of a prior art mandrel illustrating the 360° fixed teeth segments on the mandrel and the J-slot of the prior art mandrel.

Anchor cage 30 has friction pads 32 thereon which are urged outwardly by springs 33 to contact the sides of the well casing 11. They are forced outwardly with sufficient strength to hold approximately 200–300 pounds in friction engagement with the well casing 11. The mandrel 14 has a threaded area 38 integrally formed on the outer surface thereof and, as shown in FIG. 2, has a J-slot 40 on diametrically opposed sides thereof. In FIG. 1, a gudgeon pin 34 in the anchor cage 30 is screwed inwardly until the gudgeon pin 34 rests in the J-slot 40 as illustrated in FIG. 2.

Figure 3:
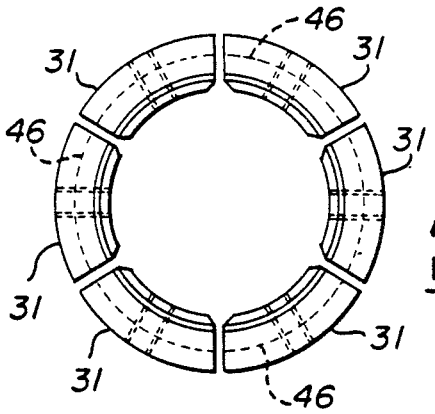
FIG. 3 PRIOR ART
FIG. 3 is a top view of the ratchetable segments of teeth which surround the mandrel and engage the 360° band of teeth on the prior art mandrel.
Figure 4:
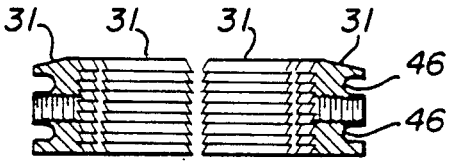
FIG. 4 PRIOR ART
FIG. 4 is a front view of one of the ratchetable segments of teeth illustrated in FIG. 2 showing the grooves which hold the springs that keep the segments urged towards the mandrel and allow them to be ratchetable over the fixed mandrel teeth.

In operation, when the entire well packer assembly 10 is attached to the drill string with coupler 12 and lowered into the well casing 11, the friction pads 32 rest against the well casing surface such that the entire system has to be forced down the well casing with the friction pads 32 in contact with well casing 11 as the assembly 10 moves down the well. Gudgeon pin 34 is caught in the uppermost portion 42 of the bottom of J-slot 40. Thus, the pressure of the drill string on the mandrel 14 forces the gudgeon pin 34, which carries the anchor cage 30, and the remainder of the well packer assembly 10, down into the well with the friction pads 32 rubbing against the well casing 11. When the packer assembly 10 reaches the level at which the packer assembly 10 is to be set, the drill string is lifted up slightly. The packer is held in place by the friction pads 32. By lifting up on the drill string and the mandrel 14, the gudgeon pin 34 drops to the bottom of the lowest portion of the J-slot as illustrated by the representation 44 in FIG. 2, thus releasing pin 34 from slot 42. By slightly rotating the drill string and mandrel 14, the gudgeon pin 34 is moved to the position designated by the numeral 34 as shown in FIG. 2. The drill string and mandrel 14 can then be lowered enabling the gudgeon pin 34 to slide up in the vertical portion of the J-slot 40. It will be noted in FIG. 1 that the anchor cage 30 is threadedly attached to the lower slip 26. In the top or uppermost portion of the anchor cage is located six ratchetable segments of teeth 31 shown in FIG. 3 that have slots 46 therein as shown in FIG. 4 for receiving resilient biasing means such as springs to urge the ratchetable teeth segments 3 inwardly towards the surface of the mandrel 14. The teeth 31 are held in engagement with the anchor cage 30 in a well-known manner by screws (not shown). The screws allow the teeth 31 to ratchet but not to rotate with respect to the anchor cage.

Referring now to FIG. 2, as the mandrel 14 is lowered through the anchor cage 30, the gudgeon pin 34 slides up the vertical portion of the J-slot 40 and the anchor cage 30 carries the ratchetable teeth 31 upwardly until they engage the elongated 360° portion of teeth 38 on mandrel 14. As can be seen in FIG. 4, the teeth on the ratchetable sections 31 are angled such that they can slip or ratchet over the fixed teeth 38 on mandrel 14, but they cannot move in the reverse direction since the teeth are angled so as to engage each other in a locking relationship. Thus by this action, the anchor cage 30 becomes rigidly attached to the mandrel 14 through the ratcheting action of teeth 31 with respect to the fixed teeth 38 on the mandrel. Once these teeth are in a latching relationship, the drill string can then be pulled upwardly pulling the attached anchor cage with it.

When this occurs, the conical surface 29 of pivotal locking teeth 28 engages the sloping surface 25 of head 24 thus forcing teeth 28 outwardly about their pivot point. Continued movement in the upper direction by mandrel 14 carries head 24, elastomer seals 22 and upper head 20 with it. When sloping surface 21 of upper head 20 engages the sloping surface 19 of upper pivotal locking teeth 18, they are forced outwardly into engagement with the well casing. These teeth are shaped such that they grip the well casing 11 in such a manner to prevent substantial continued movement of slip 16 upwardly. Therefore, continued upward movement of the mandrel 14 and the attached anchor cage 30 compresses the elastomer seals 22 forcing them outwardly into liquid sealing contact with the well casing 11. Thus, the packer is now in its set condition with the upper teeth 18 preventing the packer from moving upwardly, the lower teeth 28 preventing the packer from moving downwardly and the elastomer seals 22 being compressed such that they move outwardly and form a liquid seal with the well casing 11.

When it is desired to remove the packer from the well, the mandrel 14 must be disengaged from the anchor cage 30. The two are held together by ratchetable teeth 31 on the anchor cage and the fixed 360° section of teeth 38 on the mandrel 14. Disengaging the teeth is accomplished by rotating the mandrel 14 since the teeth 38 on the mandrel 14 and ratchetable teeth 31 on the anchor cage are formed in a threaded fashion. Thus by rotating the drill string, the ratchetable teeth 31 are threadedly removed from the teeth 38. The problem that occurs is that the drill string may drop accidentally as it is being rotated to disengage the threads. If it drops, the ratchetable teeth 31 simply ride back up over mandrel teeth 38 and re-engage the latching condition. The threading procedure must be started all over again. Thus, it is time consuming and can create difficult and costly operations to remove the well packer from the well. Once the mandrel has been disengaged from the anchor cage 30, the mandrel can be raised enabling the gudgeon pin 34 to re-enter the J-slot 40.

When this occurs, the upper shoulder 48 of the mandrel engages the upper slip 16 tending to move it upwardly a small amount. Any small amount of movement upwardly allows the biased teeth 18 to move inwardly since a gap is introduced between the sloping surfaces 19 and 21. This continued upward movement allows the upper slip 16 to be free of well casing 11 because the teeth 18 now move inwardly again by a biased force such as a spring. Continued upward movement then allows middle shoulder 50 on mandrel 14 to engage and lift upper head 20 thus releasing the pressure on the elastomer seals 22 and allowing them to move inwardly from the well casing 11. That upward movement also carries lower head 24 and cam surface 25 upwardly thus releasing lower teeth 28 which are again forced inwardly by resilient means such as springs thus releasing the lower teeth 28 from the well casing 11. The packer assembly 10 is now free from well casing 11 except for the friction pads 32. By continuing to pull the mandrel 14 upwardly, the gudgeon pin 34 strikes the bottom of J-slot 40 and, because of the sloped bottom shoulder on the bottom of the J-slot, moves the gudgeon pin to position 44. Now the drill string can be pulled upwardly and the gudgeon pin 34, which is caught in the bottom of J-slot 40, carries the entire well packer assembly back to the surface as the drill string is removed.

Figure 5:
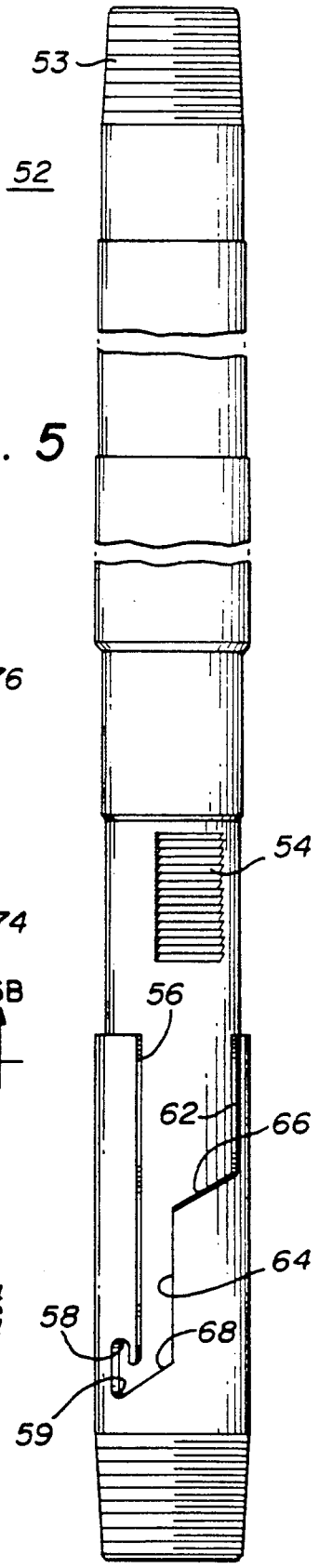
FIG. 5 illustrates the mandrel of the present invention illustrating the 60° arcuate segment of fixed teeth and the novel J-slot associated therewith on each side of the mandrel.
Figure 9:
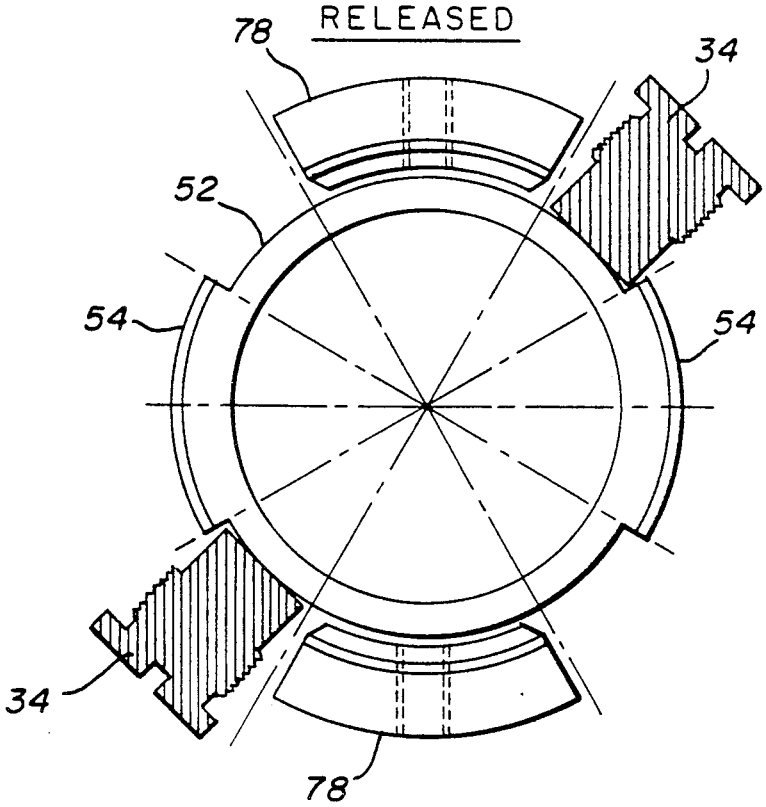
FIG. 9 is a view illustrating the released position of the ratchetable teeth segments and gudgeon pins with respect to the fixed teeth sections on the mandrel.

The present invention allows the mandrel to be released from the packer simply by rotating the mandrel no more than one-quarter of a turn. The improved mandrel 52 of the present invention is illustrated in FIG. 5. An arcuate section of fixed teeth 54 is integrally formed on opposing sides of mandrel 52 and extends longitudinally along the mandrel sides a predetermined distance. As illustrated in FIG. 9, it can be seen that each arcuate section of fixed teeth 54 is approximately a 60° segment. Diametrically opposed J-slots 60 are formed on the mandrel 52 below and spaced from the arcuate segments of fixed teeth 54 for receiving the opposed anchor cage gudgeon pins 34. Again, the bottom trap 58 of J-slot 60 traps the gudgeon pins 34 to force the entire packer assembly 10 down into the well casing against the resistance of the friction pads 32 while the mandrel 52 is lowered into the well casing on the end of the drill string. The vertical portion 56 of the J-slot 60 has an upper portion 62 that is wider than the lower portion 64. The upper portion 62 is coupled to the lower portion 64 by a first sloping shoulder 66 on one side of the J-slot. The bottom end 59 of the J-slot is coupled to the lower vertical portion 64 of the J-slot by a second sloping shoulder 68 which is essentially parallel to the first sloping shoulder 66.

Figure 6A:
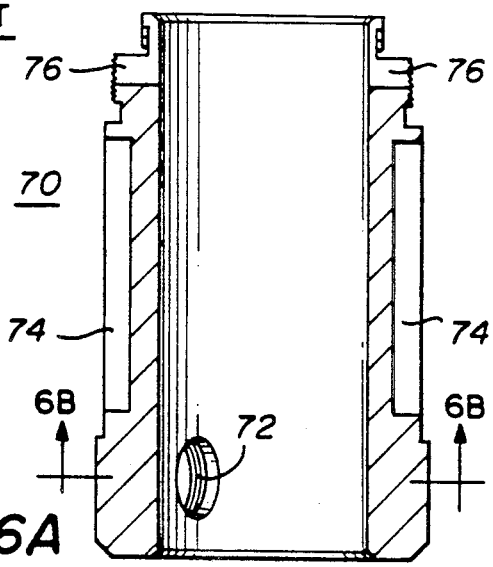
FIGS. 6A and 6B are cross-sectional views of the anchor cage of the present invention illustrating the orifices where the gudgeon pins are located and the slots on the upper portion thereof that contain the ratchetable teeth segments.
Figure 6B:
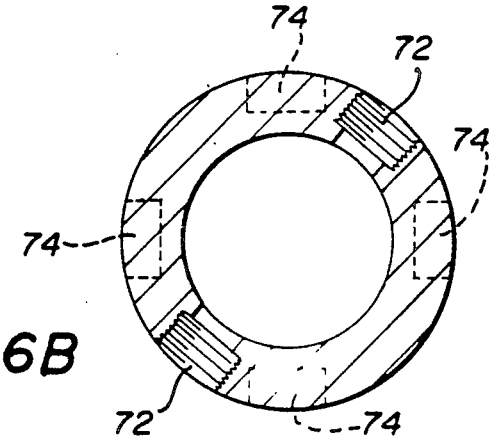
Figure 8:
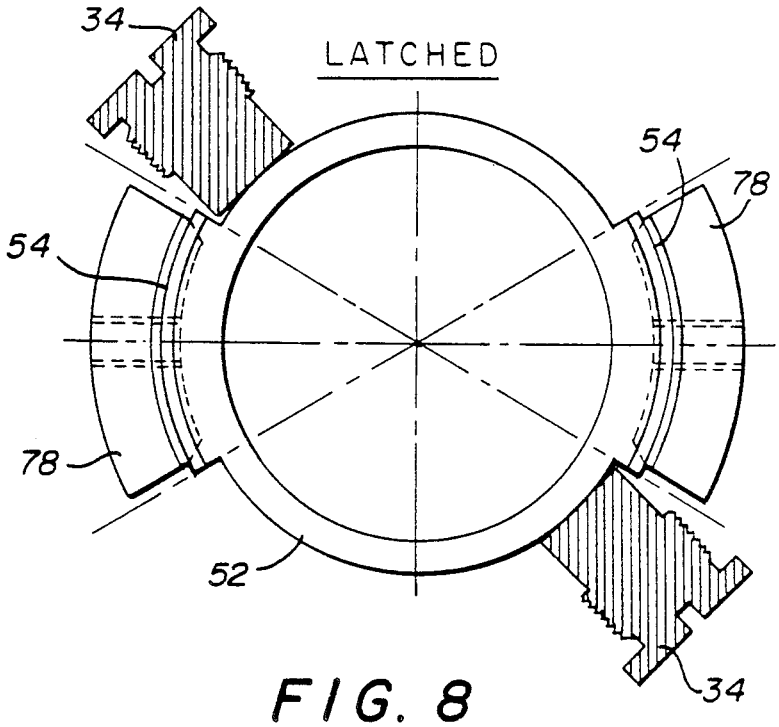
FIG. 8 is a diagrammatic representation of the relationship of the gudgeon pins and ratchetable teeth segments on the anchor cage with respect to the mandrel and the 60° arcuate section of teeth thereon in the latched position.

FIG. 6A and FIG. 6B illustrate cross-sectional views of the anchor cage 70 of the present invention. It has two diametrically opposed gudgeon pin orifices 72. It also has four friction pad slots 74 positioned 90° apart around the outer circumferences thereof. On the upper end thereof, it also has two diametrically opposed slots 76 for receiving the ratchetable segments of teeth 78. Again, as can be seen in FIG. 8 and FIG. 9, the ratchetable teeth segments 78 cover an arcuate distance of approximately 60° and essentially match the fixed arcuate sections of teeth 54 on opposing sides of the mandrel. While the 60° arcuate segments of teeth are clearly the preferred embodiment, it is possible to use only one arcuate segment of fixed teeth having an arcuate length up to 180° and a corresponding ratchetable section of teeth having an arcuate length up to 180°. In such case, rotation of the drill string and mandrel less than one turn would disengage the teeth. Other combinations such as four 30° arcuate sections of teeth spaced 90° apart would also function to achieve the desired results.

Figures 7A, 7B, 7C, 7D:
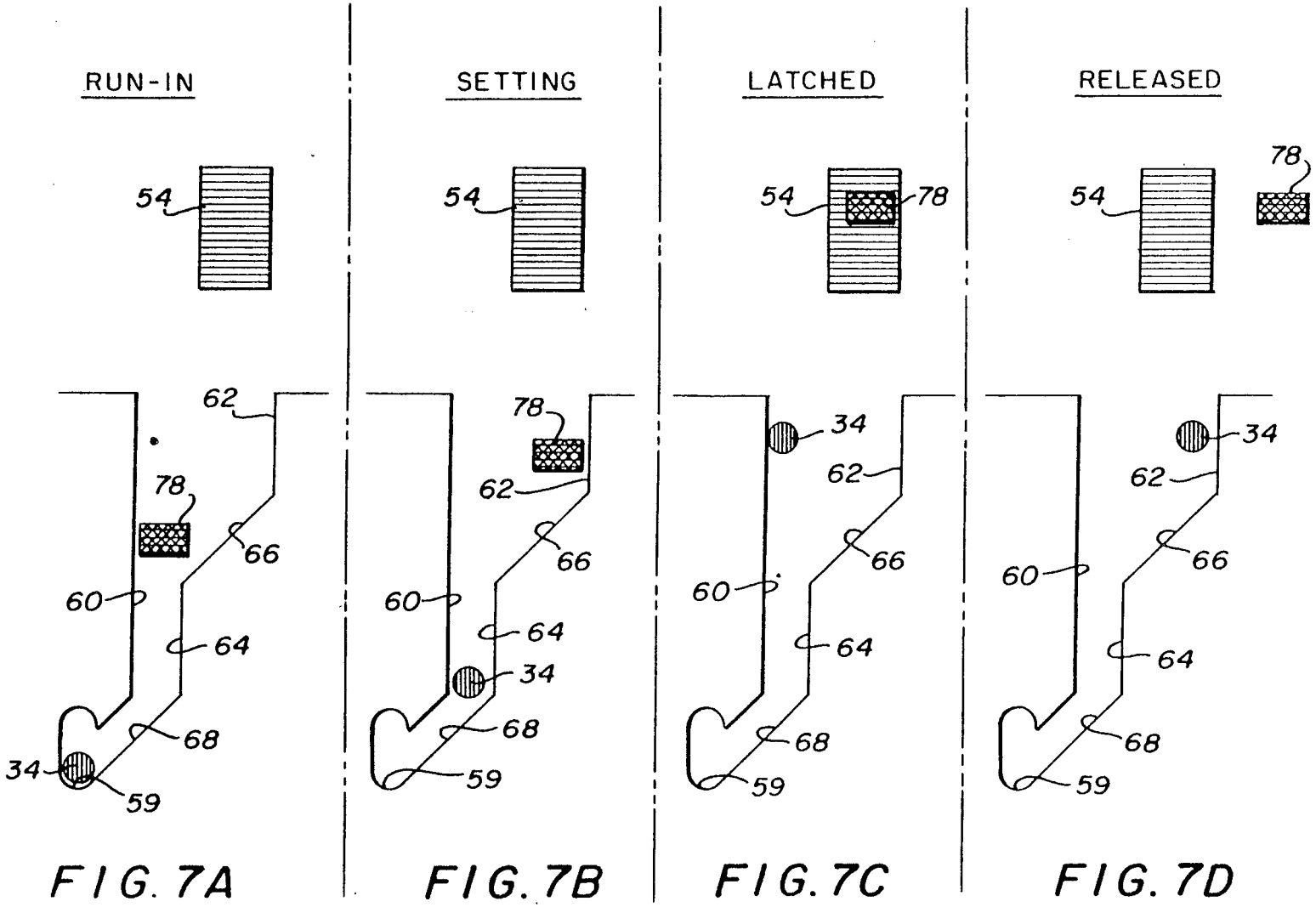
FIGS. 7A, 7B, 7C and 7D illustrate the relationship of the mandrel teeth sections and J-slot to the anchor cage gudgeon pin and ratchetable teeth segments in the run-in position, the position for setting the well packer, the latched position in which the mandrel is latched to the anchor cage and thus the well packer, and the released position when the mandrel has been released from the anchor cage.

It can be seen from FIGS. 5 and 6A and 6B that any relative movement of the mandrel 52 and the anchor cage 70 causes the gudgeon pins 34 in slots 72 and the ratchetable segments of teeth 78 in slots 76 to move relative to the mandrel 52. The manner in which they move is illustrated in FIGS. 7A, 7B, 7C and 7D. In 7A, when the packer 10 has been run-in to the proper depth of the well to be set and the mandrel 52 is slightly raised, the gudgeon pin 34 fits in the bottom 59 of the J-slot 60. The ratchetable segments of teeth 78 are positioned above and arcuately spaced from gudgeon pins 34 and are positioned adjacent the first sloping surface 66 that connects the upper vertical portion 62 of the J-slot 60 to the lower vertical portion 64. By rotating the mandrel 52 one-quarter turn, the gudgeon pin 34 rides up the second shoulder 68 to the position shown in FIG. 7B. At the same time, the ratchetable segments of teeth 78 move to the position shown in FIG. 7B directly below the fixed arcuate segments of teeth 54 on the mandrel 52. By continuing to lower the mandrel 52, both the fixed teeth 54 and the J-slot 60 are moved downwardly toward the ratchetable teeth segment 78 and the gudgeon pin 34. As shown in FIG. 7C, the ratchetable teeth 78 strike fixed teeth 54 and ratchet over them until they are locked tightly together. At that point, the mandrel 54 can be lifted upwardly thus pulling the anchor cage 70 with it to set the well packer in place as explained previously.

When it is desired to release the well packer 10 from the well casing 11, the mandrel 52 is simply rotated a quarter of a turn, as shown in FIG. 7D, moving the fixed teeth 54 to the left, and unlatching the ratchetable teeth 78 from the fixed teeth 54. At this point, the drill string and mandrel 52 can be lifted upwardly causing gudgeon pin 34 to strike first sloping shoulder 66 thus rotating the anchor cage 70 and its attached ratchetable teeth segments 78 and gudgeon pin 34 to the point shown in approximately FIG. 7B. By further movement of the mandrel 52 in the upward direction, the ratchetable teeth segments 78 and gudgeon pin 34 assume the position illustrated in FIG. 7A. At that point, the well packer has been released from contact with the well casing 11 as explained previously and can now be removed from the well.

FIG. 8 is a cross-sectional representation of the novel mandrel 52 illustrating the relative positions of the gudgeon pins 34 and the ratchetable teeth segments 78 when the ratchetable teeth 78 are in engagement with the fixed teeth 54 on mandrel 52. FIG. 9 illustrates the release position of the ratchetable teeth 78 with respect to the fixed mandrel teeth 54 and illustrates the relative positions of the gudgeon pins 34 with respect to the ratchetable teeth 78. It will be noted that the ratchetable teeth 78 and the gudgeon pin 34 always maintain the same fixed relationship simply because they are both fixed parts of the anchor cage 70 and move with it. In like manner, the fixed teeth 54 and the J-slots 60 also maintain the same fixed relationship as shown in FIGS. 7A, 7B, 7C and 7D because they are both fixed parts of the mandrel 52 and move with it. Thus to engage or latch the anchor cage to the mandrel 52, the mandrel is simply lowered straight down, as illustrated in FIG. 7C, until the latching engagement of the teeth 78 and teeth 54 occurs. When it is desired to release the engagement, the mandrel 52 is simply rotated one-quarter of a turn as illustrated in FIG. 7D to disengage the ratchetable teeth 78 and the fixed mandrel teeth 54. Thus, the present invention provides a novel well packer assembly which can be released from the attachment to the mandrel by a simple one-quarter rotation of the mandrel.

Figure 10:
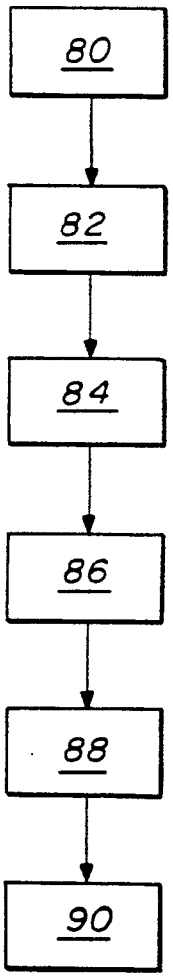
FIG. 10 is a flow chart illustrating the novel method steps for the present invention.

The novel steps of the present invention are illustrated in FIG. 10. At step 80, the packer is let down into the well to the proper location. At step 82, the mandrel teeth are latched to the packer teeth to prevent release of the packer from the well casing. At step 84, the packer is set to the well casing in a well known manner. At step 86, the mandrel is released from the packer by simply rotating the mandrel one-quarter turn when it is desired to remove the well packer assembly. At step 88, the well packer is released from the well casing and at step 90 it is removed from the well casing by removing the drill string which is attached to the mandrel.

Thus, there has been disclosed a novel well packer and well packer latching assembly which enables a well packer to be released from the mandrel by simply rotating the mandrel one-quarter of a turn. The mandrel has two opposed 60° arcuate fixed sections of teeth thereon and the anchor cage has corresponding 60° ratchetable segments of teeth thereon. After the fixed and ratchetable teeth segments are engaged by lowering the mandrel into the anchor cage, the mandrel is raised to set the packer in the well casing and the packer is held in its fixed position in the well casing. When it is desired to release the well packer from the casing, the engagement of the teeth on the mandrel and the anchor cage are released simply by turning the mandrel one-quarter turn to move the threads or teeth out of contact with each other. The well packer is then released from its contact from the well casing in a well known manner and then removed from the well.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. An improved well packer for removeable installation in a well casing with a drill string comprising:

a hollow packer housing;

upper and lower teeth pivotally attached to the housing for releasably engaging the packer housing with the well casing;

a mandrel attached to the drill string and extending through the hollow packer housing for forcing the upper and lower teeth into releasable engagement with the well casing;

an arcuate section of fixed teeth integrally formed on opposing sides of the mandrel and extending longitudinally along the mandrel sides a predetermined distance; and arcuate segments of ratchetable teeth on said packer housing for mating engagement with said fixed teeth on said mandrel to latch said mandrel to said packer housing when the packer housing is engaged with said well casing and for releasing said packer from said mandrel when said mandrel is rotated no more than one-quarter turn.

2. An improved well packer as in claim 1 further comprising:

the mandrel slidably inserted in said hollow packer housing for setting said packer housing in a fixed location in the well casing to form a liquid seal separating the well casing above and below the packer.

3. An improved well packer as in claim 2 further comprising:

a hollow anchor cage forming the lower portion of said packer housing;

friction pads mounted on said anchor cage for contacting the well casing and resisting movement of said packer assembly in said casing;

diametrically opposed gudgeon pins protruding inwardly from said anchor cage toward said mandrel;

diametrically opposed J-slots formed on said mandrel surface below and spaced from said mandrel arcuate segments of teeth for receiving said diametrically opposed anchor cage gudgeon pins, the bottom end of said J-slots trapping said gudgeon pins to force the entire packer assembly down into the well casing against the resistance of the friction pads when the mandrel is lowered into well casing on the end of the drill string;

the vertical portion of said J-slot having an upper portion wider than the lower portion, the wider portion being coupled to the lower portion by a first sloping shoulder on one side of the J-slot;

the bottom end of said J-slot being coupled to the lower portion thereof by a second sloping shoulder generally parallel to the first sloping shoulder;

arcuate segments of said teeth mounted on opposed sides of said anchor cage above and arcuately spaced from said gudgeon pins such that when the gudgeon pins are in the bottom of said J-slot, said anchor cage arcuate segments of teeth are received by the J-slot portion adjacent the first sloping shoulder; and when the mandrel is rotated to move the gudgeon pins from the bottom end of the J-slot to and in alignment with the lower vertical portion thereof, the gudgeon pins move up the second sloping shoulder thereby moving the anchor cage and causing the anchor cage arcuate segments of teeth to move upwardly rotatably and parallel to the first sloping shoulder to and in vertical alignment with said mandrel teeth segments such that when the mandrel is subsequently lowered, the anchor cage arcuate segments of teeth ratchetably engage corresponding ones of the mandrel arcuate segments of teeth to secure the mandrel to the packer housing through said anchor cage.

4. An improved well packer as in claim 3 wherein the gudgeon pins move up into the widest portion of said J-slots when said mandrel is lowered to engage the ratchetable arcuate segments of teeth on the anchor cage with the mandrel arcuate segments of teeth such that when the mandrel is rotated one-quarter turn to disengage the arcuate segments of teeth, said gudgeon pins are enabled to move from one side of said wide portion of said J-slot to the other side.

5. An improved well packer as in claim 4 wherein:

when said mandrel is raised after said arcuate segments of teeth have been disengaged, said first sloping shoulders in said J-slot engage said gudgeon pins to rotate said anchor cage and return the ratchetable arcuate segments of teeth thereon under and in vertical alignment with said arcuate segments of teeth on said mandrel; and as said mandrel is continued to be raised, said second sloping shoulder in said J-slots engages said gudgeon pins to further rotate said anchor cage and forces said gudgeon pins to the bottom portion of said J-slots to carry the packer assembly as the mandrel is raised by the drill string.

6. An improved mandrel for use in setting a well packer in a well casing comprising:

an arcuate segment of teeth integrally formed on opposing sides of the mandrel and extending along the mandrel sides a predetermined distance for use in latching said mandrel to said packer;

diametrically opposed J-slots formed on the mandrel for cooperating with said well packer to move said packer in said well casing, the J-slots having a vertical portion with an upper portion and a lower portion, said upper portion allowing said mandrel to be rotated no more than 90° with respect to the packer to unlatch said mandrel from said packer and said lower portion positioning said packer with respect to said mandrel or enabling said mandrel to be latched to said packer; and the upper portion of the vertical portion of said J-slots being wider than the lower portion and being coupled to the lower portion by a first sloping shoulder on one side of the J-slots; the lower portion having a bottom end of said J-slots being coupled to the lower vertical portion of the J-slots by a second sloping shoulder parallel to the first sloping shoulder.

7. A method of releasably installing a well packer assembly in a well casing in a desired depth with a drill staring, said packer assembly being slidably mounted on a mandrel attached to the end of the drill string, the method comprising the steps of:

lowering the well packer assembly into the well casing with the drill string to the desired depth;

forcing teeth on the packer assembly into engagement with the well casing to lock the packer assembly in place;

forming arcuate segments of teeth on opposing sides of the mandrel;

forming corresponding ratcheting arcuate segments of teeth in opposite sides of the packer assembly such that when said mandrel is lowered in said packer assembly, said arcuate segments of teeth on said mandrel and said packer assembly engaged to latch the mandrel to the packer assembly;

latching the mandrel to the packer assembly to prevent release of the packer teeth from the well casing;

releasing the arcuate sections of teeth on the mandrel from the ratcheting arcuate sections of teeth on the packer assembly by rotating the drill string and mandrel less than one-quarter turn when it is desired to remove the well packer assembly; and releasing the packer assembly teeth from engagement with the well casing to enable movement of said packer with said drill string.

8. The method of claim 7 wherein the step of releasing said mandrel from said packer assembly by rotating said mandrel no more than one-quarter turn further comprises the steps of:

forming 60° arcuate segments of teeth on said mandrel and 60° arcuate segments of ratchetable teeth on said packer assembly; and rotating the drill string and mandrel no more than one-quarter turn to disengage the 60° arcuate segments of teeth on said mandrel from the 60° arcuate segments of teeth on said packer assembly.

9. The method of claim 8 further comprising the steps of:

forming the lower portion of the packer assembly as an anchor cage;

ratchetably attaching said packer assembly arcuate segments of teeth to opposing sides of said anchor cage;

extending gudgeon pins inwardly from diametrically opposed sides of said anchor cage; and forming a J-slot on opposing sides of said mandrel below said mandrel arcuate segments of teeth to receive said inwardly extending gudgeon pins and guide said anchor cage arcuate segments of teeth into alignment with said mandrel arcuate segments of teeth to latch said mandrel to the packer assembly.

10. The method claim 9 further including the steps of:

placing friction pads on said anchor cage to contact the well casing and resist movement of said packer assembly in said casing;

forming the bottom end of said J-slots for trapping said gudgeon pins to force the entire packer assembly down into the well casing against the resistance of the friction pads as the mandrel is lowered into the well casing on the end of the drill string;

forming the vertical portion of the J-slot with an upper portion and a lower portion, the upper portion being wider than the lower portion;

coupling the upper portion of the J-slot to the lower portion with a first sloping shoulder on one side of the J-slot;

coupling the lower portion of the J-slot to the bottom portion with a second sloping shoulder parallel to the first sloping shoulder such that when said gudgeon pins are in the bottom portion of said J-slots, said anchor cage ratchetable segments of teeth are received by the J-slot portion adjacent the first sloping shoulder; and when the mandrel is rotated to move the gudgeon pins from the bottom portion of the J-slots to and in alignment with the lower vertical portion of the J-slots, the gudgeon pins move up the second sloping shoulder thereby causing the anchor cage ratchetable segments of teeth to move upwardly and rotatably parallel to the first sloping shoulder to a vertical alignment with the mandrel arcuate segments of teeth such that when the mandrel is subsequently lowered the anchor cage arcuate segments of teeth ratchetably engage corresponding ones of the mandrel arcuate segments of teeth to latch the mandrel to the packer housing through said anchor cage.

11. The method as in claim 10 further comprising the step of moving the gudgeon pins up into the widest upper portion of said J-slot when said mandrel is lowered to engage the ratchetable arcuate segments of teeth on the anchor cage and the mandrel such that when said mandrel is rotated one-quarter turn to disengage the arcuate segments of teeth, said gudgeon pins are enabled to move from one side of the wide portion of said J-slots to the other side.

12. A method as in claim 10 further comprising the steps of:

raising said mandrel after said arcuate segments of teeth have been disengaged to cause said first sloping shoulder in said J-slots to engage said gudgeon pins and rotate said anchor cage to return the ratchetable arcuate segments of teeth thereon under and in alignment with the arcuate segments of teeth on said mandrel; and continuing moving said mandrel upward to cause said second sloping shoulders of said J-slots to engage said gudgeon pins to further rotate said anchor cage and force said gudgeon pins into the bottom portion of said J-slots to carry the packer assembly as the mandrel is raised by the drill string.

13. A method of releasably latching a hollow well packer to an elongated tubular mandrel to enable the packer to be releasably set in fixed engagement with a well casing, said method comprising the steps of:

integrally forming at least one arcuate section of fixed teeth on said mandrel;

mounting at least one arcuate segment of ratchetable teeth on said well packer such that when said mandrel is moved longitudinally in one direction through said packer, said at least one arcuate segment of ratchetable teeth slidably engages said at least one arcuate section of fixed teeth on said mandrel to enable said packer to be fixedly set in said well casing, but fixedly engages said at least one arcuate segment of fixed teeth when said mandrel is moved longitudinally in the opposite direction through said packer thereby rigidly latching said packer to said mandrel; and rotating said mandrel less than one-quarter turn until said at least one arcuate segment of ratchetable teeth disengages from said at least one arcuate section of fixed teeth to release the well packer from latching engagement with the mandrel and enable the well packer to be released from the well casing.

14. An improved general purpose well packer for removeable installation in a well pipe casing in a well bore with a tubing string comprising:

a mandrel attached to the tubing string and surrounded by and coupled to the packer to carry the packer into and out of the well bore;

upper and lower slip carriers on said packer having moveable teeth for selectively and releasably engaging the pipe casing to hold the packer in place;

at least one elastomer seal positioned between the upper and lower slip carriers to form selectively a liquid seal between the packer and the pipe casing;

an anchor cage attached to the bottom of the packer and having first diametrically opposed openings therein and second recesses formed therein at 90° intervals;

a friction pad placed in each recess and being spring loaded outwardly to engage the sides of said well pipe casing, said friction pads having sufficient friction to hold the packer alone in fixed engagement with the well pipe casing;

an arcuate ratchetable segment of teeth positioned in each of the diametrically opposed openings;

means in contact with the arcuate ratchetable segments of teeth to urge the segments inwardly toward the mandrel;

a fixed elongated arcuate segment of teeth integrally formed on diametrically opposed sides of said mandrel for latching engagement with corresponding ones of the ratchetable segments of teeth when said mandrel moves downwardly with respect to the anchor cage such that the mandrel is latched to the anchor cage;

means for urging said moveable teeth in said upper and lower slip carriers outwardly into the well pipe casing when said mandrel is moved upwardly by the drill string while latched to the anchor cage to lock said packer in said casing and simultaneously expand the at least one elastomer seal to form a liquid seal between said packer and said well casing bore; and said mandrel being released from said anchor cage when said mandrel is rotated less than one turn to move said arcuate segment of teeth on said mandrel out of latching engagement with said arcuate ratchetable segment of teeth on said anchor cage.

15. A latching assembly for releasably latching a hollow well packer to an elongated tubular mandrel to enable the packer to be releasably set in fixed engagement with a well casing, said latching assembly comprising:

at least one arcuate section of fixed teeth integrally formed on said mandrel;

at least one arcuate segment of ratchetable teeth mounted on said well packer such that when said mandrel is moved longitudinally in one direction through said packer, said at least one arcuate segment of ratchetable teeth slidably engages said at least one arcuate segment of fixed teeth on said mandrel to enable said packer to be set in said well casing, but fixably engages said at least one arcuate segment of fixed teeth when said mandrel is moved longitudinally in the opposite direction through said packer thereby rigidly latching said packer to said mandrel;

said arcuate section of fixed teeth in said arcuate segment of ratchetable teeth having arcuate lengths such that the rotation of said mandrel less than one turn releases the ratchetable segment of teeth from the fixed teeth section thereby releasing the mandrel from latched engagement with the packer and enabling the packer to be released from the well casing; and said arcuate segment of ratchetable teeth in said arcuate section of fixed teeth having arcuate lengths of approximately 60°.

16. A latching assembly as in claim 15 further comprising:

a hollow anchor cage forming the lower portion of said packer;

friction pads mounted on said anchor cage for contacting the well casing and resisting movement of said packer assembly in said casing;

diametrically opposed gudgeon pins protruding inwardly from said anchor cage toward said mandrel;

diametrically opposed J-slots formed on said mandrel surface below and spaced from said mandrel arcuate segments of teeth for receiving said diametrically opposed anchor cage gudgeon pins, the bottom end of said J-slots trapping said gudgeon pins to force the entire packer assembly down into the well casing against the resistance of the friction pads when the mandrel is lowered into the well casing on the end of the drill string;

the vertical portion of said J-slots having an upper portion and lower portion, the upper portion being wider than the lower portion and being coupled to the lower portion by a first sloping shoulder on one side of the J-slots;

the bottom end of said J-slots being coupled to the lower vertical portion of the J-slots by a second sloping shoulder parallel to the first sloping shoulder;

said arcuate segments of ratchetable teeth being mounted on opposed sides of said anchor cage above and arcuately spaced from said gudgeon pins such that when the gudgeon pins are in the bottom end of said J-slots, said anchor cage arcuate segments of ratchetable teeth are received by the portion of the J-slots adjacent the first sloping shoulder; and when the mandrel is rotated to move the gudgeon pins from the bottom end of the J-slots to and in alignment with the lower vertical portion of the J-slots, the gudgeon pins move up the second sloping shoulder thereby causing the anchor cage segments of ratchetable teeth to move upwardly and rotatably parallel to the first sloping shoulder to and in vertical alignment with said arcuate segment of fixed teeth on the mandrel such that when the mandrel is subsequently lowered the anchor cage arcuate segments of ratchetable teeth rotatably engage corresponding ones of the mandrel arcuate teeth segments to latch the mandrel to the packer housing through said anchor cage.

17. A latching assembly as in claim 16 wherein the gudgeon pins move up into the widest upper portion of said J-slots when said mandrel is lowered to engage the arcuate segments of ratchetable teeth on the anchor cage with the fixed mandrel teeth such that when the mandrel is rotated one-quarter turn to disengage the arcuate segments of teeth, said gudgeon pins are enabled to move from one side of the wide portion of the J-slots to the other side.

18. A latching assembly as in claim 17 wherein:

as said mandrel is raised after said arcuate segments of teeth have been disengaged, said first sloping shoulder in said J-slots engages said gudgeon pins to rotate said anchor cage and returns the ratchetable arcuate segments of teeth thereon under and in vertical alignment with said arcuate segments of teeth on said mandrel; and wherein as said mandrel is continued to be raised said second sloping shoulder engages said gudgeon pins to further rotate said anchor cage and forces said gudgeon pins into the bottom portion of said J-slots to carry the packer assembly as the mandrel is raised by the drill string.

* * * * *